US006260445B1

(12) United States Patent
DeVecchis et al.

(10) Patent No.: US 6,260,445 B1
(45) Date of Patent: Jul. 17, 2001

(54) RATCHETING COMPOSITE SCREWDRIVER

(75) Inventors: Marco E. DeVecchis, Racine; Walter Gedgaudas, Kenosha, both of WI (US)

(73) Assignee: Snap-on Tools Company, Kenosha, WI (US)

( * ) Notice: Subject to any disclaimer, the term of this patent is extended or adjusted under 35 U.S.C. 154(b) by 0 days.

(21) Appl. No.: 09/767,047

(22) Filed: Jan. 22, 2001

Related U.S. Application Data

(63) Continuation-in-part of application No. 09/390,777, filed on Sep. 7, 1999.

(51) Int. Cl.[7] ..... B25B 13/46
(52) U.S. Cl. ..... 81/60; 81/58; 81/438
(58) Field of Search ..... 81/60, 58, 58.4, 81/59.1, 61, 62, 63, 63.1, 63.2, 438

(56) References Cited

U.S. PATENT DOCUMENTS

| | | |
|---|---|---|
| 3,519,294 | 7/1970 | Barnes . |
| 4,235,133 | 11/1980 | Acevedo . |
| 4,715,739 | 12/1987 | Ruegg et al. . |
| 4,777,852 | 10/1988 | Herman et al. . |
| 4,832,573 | 5/1989 | Dorski . |
| 5,031,272 | 7/1991 | Carmien . |
| 5,046,387 | 9/1991 | Levake . |
| 5,063,797 | 11/1991 | Huang . |
| 5,152,631 | 10/1992 | Bauer . |
| 5,213,014 | 5/1993 | Carmien . |
| 5,259,277 | 11/1993 | Zurbuchen . |
| 5,325,745 | 7/1994 | Koehler . |
| 5,375,486 | 12/1994 | Carmien . |
| 5,437,212 | 8/1995 | Thompson et al. . |
| 5,490,437 | 2/1996 | Hebert et al. . |
| 5,515,754 | 5/1996 | Elkins . |
| 5,526,724 | 6/1996 | Bruggeman . |
| 5,533,429 | 7/1996 | Kozak . |
| 5,535,648 | 7/1996 | Braun et al. . |
| 5,711,193 | 1/1998 | Eggert et al. . |
| 5,894,765 | 4/1999 | Anderson et al. . |
| 5,957,014 | 9/1999 | Tseng et al. . |

*Primary Examiner*—James G. Smith
*Assistant Examiner*—Hadi Shakeri
(74) *Attorney, Agent, or Firm*—Seyfarth Shaw

(57) ABSTRACT

An insulating ratcheting screwdriver includes an elongated composite shank formed of electrically insulating material and provided with a bit holder at a working end thereof. The other end of the shank has an axial recess in which is disposed one end of a hexagonal connecting pin, the other end of which is press-fitted in an axial bore in one end of a metal coupler for joining the coupler to the shank. The metal coupler is removably received in a receptacle formed in a ratchet mechanism disposed in one end of an elongated, electrically insulating handle.

20 Claims, 1 Drawing Sheet

RATCHETING COMPOSITE SCREWDRIVER

RELATED APPLICATION

This is a continuation-in-part application of U.S. patent application Ser. No. 09/390,777, filed Sep. 7, 1999, and entitled "Ratcheting Composite Screwdriver."

BACKGROUND OF THE INVENTION

1. Field of the Invention

The present invention relates to hand tools of the type which are relatively non-conducting electrically and, in particular, to ratcheting-type hand tools.

2. Description of the Prior Art

This invention is an improvement of ratcheting-type drivers, such as screwdrivers, of the type disclosed, for example, in U.S. Pat. No. 5,437,212. Such drivers include an elongated handle with an axial recess in one end, in which is received a ratchet mechanism. The ratchet mechanism defines a receptacle which removably receives one end of an associated shank. Typically, the shank has a rectangular end portion which is mateably received in a complementary portion of the receptacle to engage the shank with the ratchet mechanism. The shank is typically formed of a suitable metal, such as steel, and may either have a working end formed in the shape of an associated driver bit, such as a screwdriver blade, or may carry a bit holder for receiving therein an associated bit. Such ratcheting drivers are not suitable for safe use in certain types of applications where they may come in contact with sources of electrical power.

It is known to provide electrically insulating hand tools with both handle and shank formed of electrically insulating material. One such arrangement is disclosed, for example, in U.S. Pat. No. 5,259,277 discloses a tool having an electrically insulating handle with a axial bore formed in one end thereof for receiving an end of an associated composite shank formed of electrically insulating material. The shank is fixedly secured to the handle, as by adhesive attachment. However, such a shank is not suitable for use in a ratcheting tool, wherein the shank must be easily removable. It would be possible to dimension and shape the handle end of the shank so as to have a rectangular portion which could be mateably received in the receptacle of an associated ratchet mechanism. However, it has been found that the composite material of the shank of U.S. Pat. No. 5,259,277 does not readily lend itself to formation into a rectangular coupling end, nor does it have the requisite wear resistance for removable mating in a complementary receptacle in a ratchet mechanism.

SUMMARY OF THE INVENTION

It is a general object of the invention to provide an improved ratcheting hand tool which avoids the disadvantages of prior ratcheting hand tools while affording additional structural and operating advantages.

An important feature of the invention is the provision of an electrically insulating hand tool including a shank which is formed of electrically insulating material and yet has the necessary wear characteristics for removable engagement in the handle structure.

In connection with the foregoing feature, another feature of the invention is the provision of a hand tool of the type set forth which is of simple and economical construction.

Yet another feature of the invention is the provision of a ratcheting hand tool of the type set forth.

In connection with the foregoing features, a further feature of the invention is the provision of a shank assembly including a metal coupler for mateable engagement in a handle structure, an electrically insulating exposed portion, and a technique for effectively joining the two.

The foregoing features are attained by providing an insulating hand tool comprising: an elongated shank formed of an electrically insulating material and having a handle end and a working end and a longitudinal axis and a first axial bore formed in the handle end, a handle formed of electrically insulating material and having an axial receptacle in one end thereof, a metal coupler receivable in the receptacle and having a second axial bore in one end thereof, and a hexagonal connecting pin having first and second ends respectively press-fitted in the first and second bores for joining the shank to the coupler.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
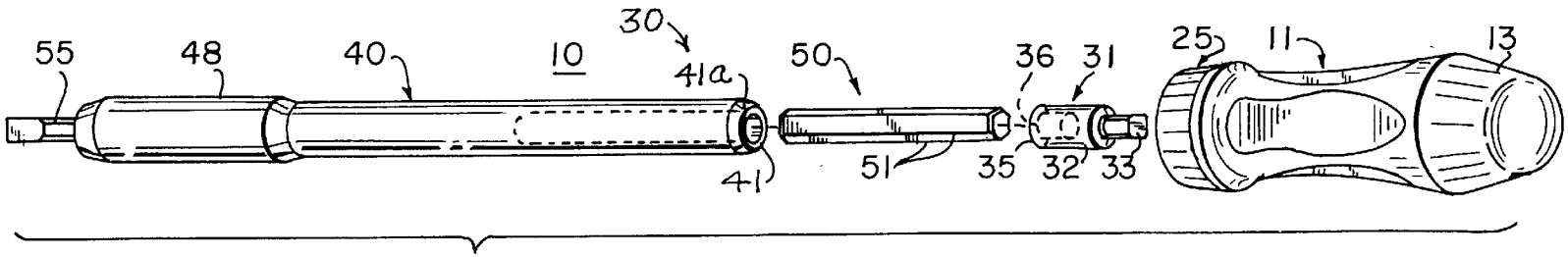
FIG. 1 is an exploded perspective view of a ratcheting hand tool constructed in accordance with and embodying the features of the present invention.
Figure 2:
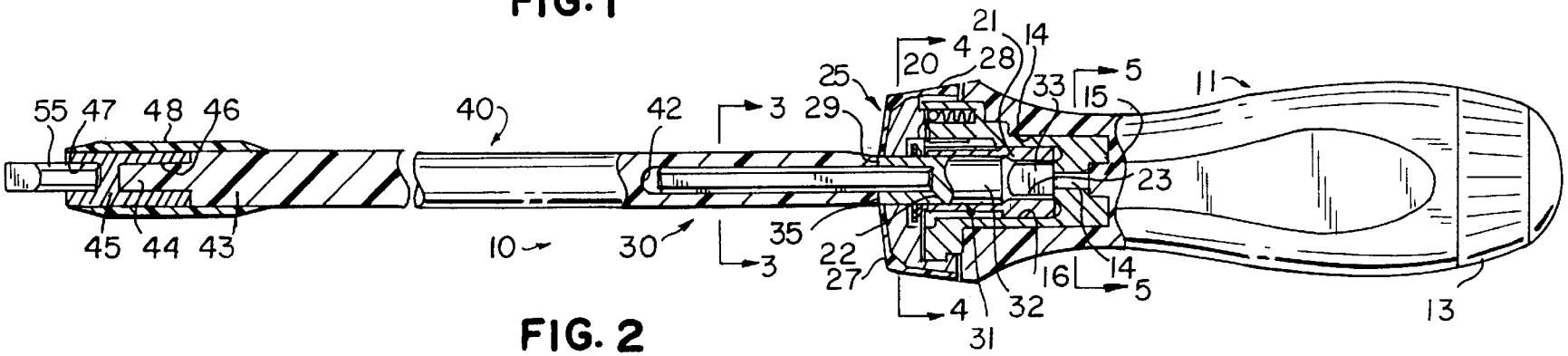
FIG. 2 is an enlarged side elevational view of the assembled tool of FIG. 1, in partial vertical section and with portions broken away.
Figure 5:
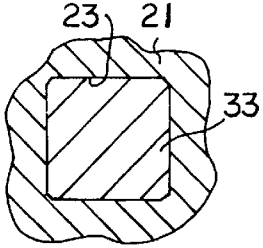
FIG. 5 is a further enlarged fragmentary view in vertical section taken along the line 5—5 in FIG. 2.

Referring to FIGS. 1, 2 and 5, there is illustrated a hand tool, generally designated by the numeral 10, constructed in accordance with the present invention. The hand tool 10 is in the form of a ratcheting screwdriver, but it will be appreciated that the principles of the present invention would be applicable to other types of ratcheting drivers and other types of hand tools. The hand tool 10 includes an elongated handle 11, which is preferably formed of a suitable electrically insulating material, such as a suitable plastic material. The handle 10 may have an axial bore formed in the rear end thereof to define a storage compartment (not shown) closed by a removable cap 13. Preferably, the handle 11 has an axial bore 14 formed in the forward end thereof, in which is received a metal insert 15, which may be of the type disclosed in U.S. Pat. No. 4,777,852. The insert 15 has an axial bore 16 formed in the forward end thereof for receiving therein a ratchet mechanism, generally designated by the numeral 20, which may be of the type disclosed in the aforementioned U.S. Pat. No. 4,777,852. More specifically, the ratchet mechanism preferably includes an annular gear 21 rotatably mounted in the bore 16 coaxially therewith. The gear 21 defining an axial receptacle 22 which is circularly cylindrical in transverse cross section over most of its length, but is provided with a square end portion 23 at the rear end thereof.

Preferably, the insert 15 projects forwardly of the front end of the handle 11 and receives thereover a generally cup-shaped control cap 25, which has an inner core 26 and an outer cover 27 formed of a suitable electrically insulating material defining a generally cylindrical skirt portion 28. The cap 25 has a circular end wall which has centrally formed therethrough an axial bore 29. Preferably, the control cap 29 is rotatable relative to the handle 11 and the insert 15 for shifting the ratchet mechanism 20 between forward and reverse conditions, all as is described in greater detail in the aforementioned U.S. Pat. No. 4,777,852, the disclosure of which is incorporated herein by reference.

Figure 4:
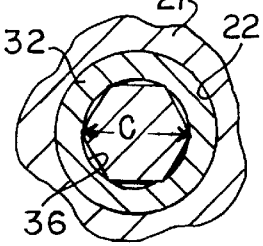
FIG. 4 is a further enlarged fragmentary view in vertical section taken along the line 4—4 in FIG. 2.

The hand tool 10 also includes a shaft assembly, generally designated by the numeral 30, which includes a metal coupler 31, a composite shank 40 and a coupling pin 50 joining the coupler 31 to the shank 40. Referring to FIGS. 4 and 5, the coupler 31 has a cylindrical main body portion 32 provided at the rear end thereof with an engagement end 33, which is substantially square in transverse cross section. The coupler 31 is dimensioned to be received in the receptacle 22 of the gear 21 with the engagement end 33 being mateably received in the square end portion 23 of the receptacle 22, as is shown in FIGS. 2 and 5. The cylindrical body 32 of the coupler 31 has a circular end face 35 in which is formed an axial bore 36, which is preferably circularly cylindrical in transverse cross section having a diameter D1 (see FIG. 4).

Figure 3:
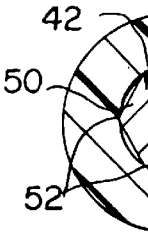
FIG. 3 is a further enlarged view in vertical section taken along the line 3—3 in FIG. 2.

Referring also to FIG. 3, the composite shank 40 may of the type disclosed in the aforementioned U.S. Pat. No. 5,259,277, the disclosure of which is also incorporated herein by reference. More specifically, the shank 40 may have a solid, electrically insulating core formed of pultruded polyester/glass material and an outer layer of glass/epoxy structure applied over the core along its entire length. The shank 40 is substantially circularly cylindrical in transverse cross section, having a circular end face 41 at a handle end thereof provided with a beveled edge, as at 41*a*. Formed in the end face 41 is an axial bore or recess 42, which is circular in transverse cross section and has a predetermined diameter (see FIG. 3), which is preferably substantially the same as the diameter of the bore 36 in the coupler 31. The shank 40 has a working end 43 which is preferably provided with a reduced-diameter tip 44 to facilitate coupling to an associated bit holder 45, which may be formed of a suitable metal. More specifically, the bit holder 45 preferably has an axial recess 46 formed in the rear end thereof adapted to receive the reduced tip 44 of the shank 40 therein for fixed attachment thereto, as by the use of a suitable adhesive. The forward end of the bit holder 45 has formed axially therein a socket 47, which may be hexagonal in transverse cross section for removably receiving therein an associated bit 55. An elongated plastic sleeve 48 fits over the bit holder 45 and the adjacent end of the shank 40.

The coupling pin 50 is formed of a suitable material, such as a hard steel, and is preferably hexagonal in transverse cross section having flats 51 intersecting at corners 52, the pin 50 having an across-corners dimension C (see FIGS. 3 and 4), which is preferably slightly greater than either of the diameters D1 or D2.

In assembly, one end of the coupling pin 50 is permanently press-fitted in the axial bore 36 of the coupler 31, while the other end of the coupling pin 50 is press fitted in the axial bore 42 of the shank 40. The length of the pin 50 and the depths of the bores 36 and 42 are such that the parts can be joined together with the end faces 35 and 41 of the coupler 31 and shank 40 being disposed in abutting contact with each other, as shown in FIG. 2. Preferably, the coupler 31 has a length such that, when it is fully seated in the receptacle 22 of the ratchet mechanism 20, the end face 35 thereof does not project axially outwardly beyond the end of the control cap 25. Similarly, the bit holder 45 does not project axially outwardly beyond the forward end of the sleeve 48. Thus, when the parts are assembled in the manner illustrated in FIG. 2, there is no exposed metal of the hand tool 10. Thus, the only exposed metal is the bit 55, which is adapted to be received in the bit holder 45 of the handle 10 for rotational driving thereby, all in a known manner.

It is a significant aspect of the present invention that the shaft assembly 30 provides a good electrically insulating shank construction while, at the same time, having a metal coupler 31 which has the wear resistance characteristics sufficient to stand up to repeated insertion and removal in the ratchet mechanism 20 and rotational engagement therewith. The use of the press-fitted coupling pin 50 permits a firm, rigid, non-rotational coupling between the coupler 31 and the shank 40, despite the dissimilarity of the materials thereof.

While the coupling pin 50 is preferably press-fitted in bores in the coupler 31 and the shank 40, the shank 40 could be insert molded around one end of the pin 50.

From the foregoing, it can be seen that there has been provided an improved hand tool which is adapted for ratcheting operation while, at the same time, having an electrically insulating construction which protects the user from electrical shock hazard.

While a particular embodiment of the present invention has been shown and described, it will be obvious to those skilled in the art that changes and modifications maybe made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An insulating hand tool comprising:

an elongated shank formed of an electrically insulating material and having a handle end and a working end and a longitudinal axis and an axial recess in the handle end, a handle formed of electrically insulating material and having an axial receptacle in one end thereof, a metal coupler receivable in said receptacle and having a axial bore in one end thereof, and a hexagonal connecting pin having first and second ends respectively fixedly and permanently secured in said recess and said bore for joining said shank to said coupler.

2. The hand tool of claim 1, wherein said shank has a composite construction.

3. The hand tool of claim 2, wherein said shank includes a core formed of a glass-fiber-reinforced plastic material.

4. The hand tool of claim 1, and further comprising a bit holder coupled to said shank at the working end thereof and adapted for receiving an associated bit.

5. The hand tool of claim 1, wherein each of said recess and said bore is substantially circularly cylindrical in transverse cross section.

6. The hand tool of claim 5, wherein said recess and said bore respectively have first and second predetermined diameters, said hexagonal connecting pin having an across-corners dimension slightly greater than either of said predetermined diameters.

7. The hand tool of claim 1, wherein said handle end of said shank has a first end face and said one end of said coupler has a second end face, said connecting pin joining said shank to said coupler in a connected condition wherein said first and second faces are disposed in abutting contact with each other.

8. The hand tool of claim 1, wherein said receptacle includes a first engagement portion of non-circular transverse cross section, said coupler including a second engagement portion of non-circular transverse cross section mateably engageable in said first engagement portion of said receptacle.

9. The hand tool of claim 1, wherein said connecting pin is formed of suitable steel.

10. The hand tool of claim 1, wherein said connecting pin is press-fitted in said recess and said bore.

11. An insulating ratcheting driver tool comprising:

an elongated shank formed of an electrically insulating material and having a handle end and a working end and a longitudinal axis and a first axial recess in the handle end, a handle formed of electrically insulating material and having a second axial recess in one end thereof, ratchet mechanism disposed in said second recess and including a gear and a pawl assembly engageable with said gear, said ratchet mechanism defining a receptacle, a metal coupler receivable in said receptacle for engagement with said ratchet mechanism and having an axial bore in one end thereof, and a hexagonal connecting pin having first and second ends respectively fixedly and permanently secured in said first recess and said bore for joining said shank to said coupler.

12. The driver tool of claim 11, wherein said shank has a composite construction.

13. The driver tool of claim 12, wherein said shank includes a core formed of a glass-fiber-reinforced plastic material.

14. The driver tool of claim 11, and further comprising a bit holder coupled to said shank at the working end thereof and adapted for receiving an associated bit.

15. The driver tool of claim 11, wherein each of said first recess and said bore is substantially circularly cylindrical in transverse cross section.

16. The driver tool of claim 15, wherein said first recess and said bore respectively have first and second predetermined diameters, said hexagonal connecting pin having an across-corners dimension slightly greater than either of said predetermined diameters.

17. The driver tool of claim 11, wherein said handle end of said shank has a first end face and said one end of said coupler has a second end face, said connecting pin joining said shank to said coupler in a connected condition wherein said first and second faces are disposed in abutting contact with each other.

18. The driver tool of claim 11, wherein said receptacle includes a first engagement portion of non-circular transverse cross section, said coupler including a second engagement portion of non-circular transverse cross section mateably engageable in said first engagement portion of said receptacle.

19. The driver tool of claim 11, wherein said connecting pin is formed of suitable steel.

20. The driver tool of claim 11, wherein said connecting pin is press-fitted in said first recess and said bore.

* * * * *